US006392367B1

(12) United States Patent
Heike et al.

(10) Patent No.: US 6,392,367 B1
(45) Date of Patent: May 21, 2002

(54) ELECTRIC DISCHARGE LAMP LIGHTING DEVICE

(75) Inventors: Atsushi Heike, Ehime-ken; Tomohiro Mizoguchi, Imabari, both of (JP)

(73) Assignee: Harison Toshiba Lighting Co., Ltd., Imabari (JP)

( * ) Notice: Subject to any disclaimer, the term of this patent is extended or adjusted under 35 U.S.C. 154(b) by 0 days.

(21) Appl. No.: 09/735,852

(22) Filed: Dec. 13, 2000

(30) Foreign Application Priority Data

Jul. 12, 2000 (JP) ..... 2000-248001

(51) Int. Cl.[7] ..... G05F 1/00; H05B 41/16; H05B 37/00

(52) U.S. Cl. ..... 315/291; 315/276; 315/312

(58) Field of Search ..... 315/291, 57, 224, 315/206, 307, 312, 297, 209 R, 314, 316, 320, 324, 276; 307/66

(56) References Cited

U.S. PATENT DOCUMENTS 4,508,996 A * 4/1985 Clegg et al. ..... 315/224
4,751,398 A * 6/1988 Ertz, III ..... 307/66
RE33,057 E * 9/1989 Clegg et al. ..... 315/224
5,838,116 A * 11/1998 Katyl et al. ..... 315/307
6,320,329 B1 * 11/2001 Wacyk ..... 315/291

FOREIGN PATENT DOCUMENTS

JP 2000-012256 A 1/2000

* cited by examiner

*Primary Examiner*—Don Wong
*Assistant Examiner*—Chuc D Tran
(74) *Attorney, Agent, or Firm*—Knobbe, Martens, Olson and Bear, LLP.

(57) ABSTRACT

A DC power source is connected to a base of a transistor of each of inverter circuit through a resistance in series. A primary winding having an intermediate tap of an inverter transformer, a resonance capacitor and a primary winding of a synchronization transformer are connected together in parallel between collectors of a pair of transistors having grounded emitters. Secondary windings of the synchronization transformers of the inverter circuits are connected together in parallel

6 Claims, 7 Drawing Sheets

ELECTRIC DISCHARGE LAMP LIGHTING DEVICE

BACKGROUND OF THE INVENTION

1. Field of the Invention

This invention relates to an electric discharge lamp lighting device suitably applied to lighting of a plurality of electric discharge lamps used as a back light source of a liquid crystal display available for a liquid crystal television, a personal computer, a word processor or the like. More particularly, the present invention is concerned with an electric discharge lamp lighting device, which permits a liquid crystal display screen to be free from flicker.

2. Description of the Prior Art

An electric discharge lamp lighting device as one of the prior arts for lighting of a plurality of electric discharge lamps is configured as shown in FIG. 7. In this case, inverter circuits 20 are connected in parallel to a DC power source 2, and an electric discharge lamp 1 is provided on the output side of each inverter circuit 20.

In an electric discharge lamp lighting device of a type using a synchronous circuit, an inverter transformer needs a tertiary winding making no connection to the base side of a transistor, as disclosed in Japanese Patent Laid-open No. 2000-12255, for instance.

Since the electric discharge lamp lighting device as shown in FIG. 7 in the above prior art needs the plurality of parallel-arranged inverter circuits for lighting of a large number of electric discharge lamps, oscillations at different frequencies occur depending on variations in fixed number of components required for each inverter circuit and a difference in loading state. Thus, there is a problem of flicker of the electric discharge lamps, resulting in flicker of a liquid crystal display screen.

A problem with the electric discharge lamp lighting device of the type using the synchronous circuit is that it is not possible to use the synchronous circuit unless the inverter transformer has the tertiary winding making no connection to the base side of the transistor.

SUMMARY OF THE INVENTION

In view of the above circumstances, it is an object of the present invention to provide an electric discharge lamp lighting device, which permits synchronization of oscillation frequencies of inverter circuits to eliminate flicker from electric discharge lamps, in its turn, flicker from a liquid crystal display screen by connecting a primary winding of each separately-provided synchronization transformer in parallel between collectors of a pair of transistors of the electric discharge lamp lighting device including a resonance-type Royer's inverter circuit as one of components, while connecting secondary windings of the synchronization transformers in parallel to each other.

For achieving the above object, according to the present invention as defined in claim 1, there is provided an electric discharge lamp lighting device comprising an inverter circuit, which uses a DC power source as input, and is configured that a primary winding having an intermediate tap of an inverter transformer, a resonance capacitor and a primary winding of a synchronization transformer are connected together in parallel between collectors of a pair of transistors, an electric discharge lamp is connected in parallel to a secondary winding of the inverter transformer to supply discharge power to the electric discharge lamp, the opposite terminals of a tertiary winding of the inverter transformer are connected to the bases of the transistors respectively for switching operation of the transistors by application of feedback voltage from the tertiary winding of the inverter transformer, and a secondary winding is provided for the synchronization transformer. The inverter circuit is provided every electric discharge lamp, and the secondary winding of the synchronization transformer of one inverter circuit is connected in parallel to the secondary winding of the synchronization transformer of, the other inverter circuit for synchronization of oscillation frequencies of a plurality of inverter circuits.

An electric discharge lamp lighting device according to the present invention as defined in claim 2 is characterized in that one terminal of the secondary winding of the above synchronization transformer is connected in parallel to the secondary winding of the synchronization transformer of the other inverter circuit through a switch. Thus, independent DUTY dimming and lighting-off of the electric discharge lamp are permitted without the need for synchronization of only a desired inverter circuit.

An electric discharge lamp lighting device according to the present invention as defined in claim 3 is characterized in that one terminal of the secondary winding of the above synchronization transformer is grounded. Thus, the circuit configuration is simplified to facilitate manufacture of a substrate.

An electric discharge lamp lighting device according to the present invention as defined in claim 4 is characterized in that one terminal of the secondary winding of the above synchronization transformer is grounded through a switch. Thus, only a desired inverter circuit may be disconnected from synchronization, and besides, the circuit configuration is simplified.

An electric discharge lamp lighting device according to the present invention as defined in claim 5 is characterized in that one terminal of the secondary winding of each synchronization transformer is grounded through a rectifying circuit and a switch, and the other terminal of the secondary winding of each synchronization transformer is made connection while being grounded through an element having an inductance component.

An electric discharge lamp lighting device according to the present invention as defined in claim 6 is characterized in that one terminal of the secondary winding of each synchronization transformer is grounded, and the other terminal of the secondary winding of each synchronization transformer is made connection while being grounded through an element having an inductance component.

BRIEF DESCRIPTION OF THE DRAWINGS

The foregoing and other objects and features of the invention will become apparent from the following description of preferred embodiments of the invention with reference to the accompanying drawings, in which.

DESCRIPTION OF PREFERRED EMBODIMENTS

Figure 1:
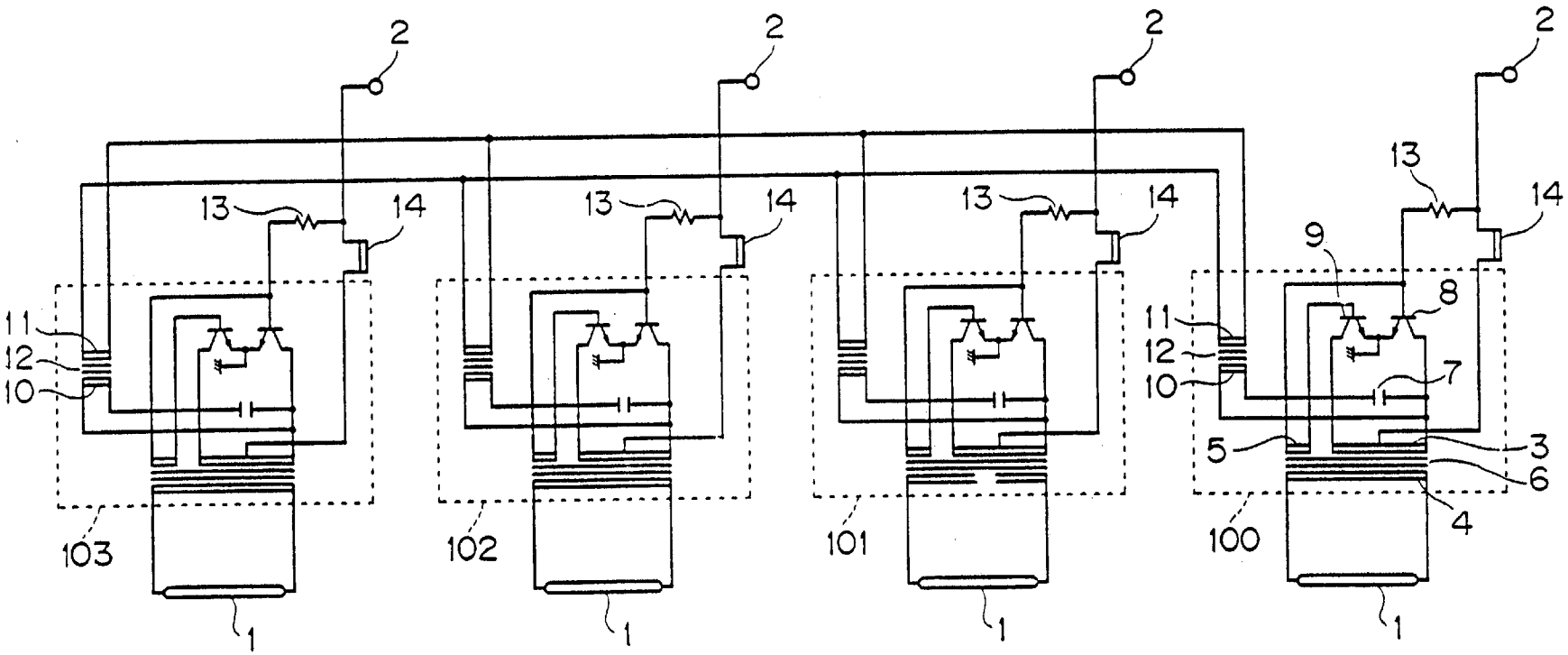
FIG. 1 is a circuit diagram showing the configuration of the first embodiment.

FIG. 1 is a circuit diagram showing the first embodiment according to the present invention. In the first embodiment, a DC power source 2 is provided every electric discharge lamp 1. Further, each of inverter circuits 100, 101, 102 and 103 of the same configuration is connected to each DC power source every electric discharge lamp. Each of the inverter circuits 100, 101, 102 and 103 is configured by connecting a synchronous circuit to a generally well-known resonance-type Royer's inverter circuit and comprises an inverter transformer 6 having a primary winding 3 on the input side and a secondary winding 4 and a tertiary winding 5 on the output side, a resonance capacitor 7 for configuring an inductance component of the inverter transformer 6 and an LC resonance circuit and transistors 8, 9 respectively having grounded emitters for driving the inverter transformer 6. In this case, each inverter circuit further comprises a synchronization transformer 12 having a primary winding 10 and a secondary winding 11.

A description will now be specifically given of the configuration of each inverter circuit. The DC power source 2 is connected to a base of the transistor 8, that is, the input side of each of the inverter circuits 100, 101, 102 and 103 through a resistance 13, which is adapted to supply drive current to the transistor 8, in series. The primary winding 3 having an intermediate tap of the inverter transformer 6 is connected in parallel between the collectors of a pair of transistors 8, 9 respectively having the grounded emitters, and a resonance capacitor 7 is also connected in parallel. The DC power source 2 is also connected to the intermediate tap of the primary winding 3 of the inverter transformer 6 through an inductor 14, which includes a choke coil for converting current supplied to the inverter circuits 100, 101, 102 and 103 into constant current, in series. The secondary winding 4 of the inverter transformer 6 is formed to be greater in number of turns than the primary winding 3 thereof so as to permit boosting. The electric discharge lamp 1 is connected in parallel to the secondary winding 4 of the inverter transformer 6 to supply current to the electric discharge lamp 1. One end of the tertiary winding 5 of the inverter transformer 6 is connected to the base side of the transistor 8, and the other end is connected to the base side of the transistor 9 to apply voltage generated on the tertiary side through feedback to the bases of the transistors 8, 9. The primary winding 10 of the synchronization transformer 12 is connected in parallel to the primary winding 3 of the inverter transformer 6. The secondary winding 11 of the synchronization transformer 12 is connected in parallel to the secondary winding 11 of the synchronization transformer 12 of the other inverter circuit.

A description will now be given of the operation of the first embodiment. With the application of the DC power source 2, current flows to the primary winding 3 of the inverter transformer 6 through the inductor 14. In this case, current flows further to the primary winding 10 of the synchronization transformer 12, and at the same time, voltage outputted from the DC power source 2 is applied to the base of the transistor 8 through the resistance 13. Then, resonance is made by the reactance of the primary winding 3 of the inverter transformer 6 and the primary winding 10 of the synchronization transformer 12 and the resonance capacitor 7. Thus, high voltage obtained by boosting by a turn ratio of the primary winding 3 to the tertiary winding 5 of the inverter transformer 6 is caused between the terminals of the tertiary winding 5 of the inverter transformer 6. At the same time, current flows to the tertiary winding 5 of the inverter transformer 6 in the same direction as the current flow direction of the primary winding 3 of the inverter transformer 6. Also, voltage obtained by boosting by a turn ratio of the primary winding 10 to the secondary winding 11 of the synchronization transformer 12 is caused between the terminals of the secondary winding 11 of the synchronization transformer 12. The synchronization transformers 12 of the inverter circuits 100, 101, 102 and 103 are connected together in parallel to form a closed circuit. Thus, a value of resonance current flowing through the closed circuit remains unchanged, when a value of DC voltage applied to a portion between the terminals of each DC power source 2 is constant. In this case, a value of resonance current of the secondary winding 11 of each synchronization transformer 12 is also identical. Voltage generated in the secondary winding 11 of the synchronization transformer 12 is led to the primary winding 10 of the synchronization transformer 12 through the synchronization transformer 12 to synchronize the resonance frequency of the primary winding 10 of the synchronization transformer 12 with that of the tertiary winding 5 of the inverter transformer 6 through the inverter transformer 6, resulting in alternate continuity of the transistors 8, 9 at the synchronized resonance frequency. Then, boosting is made by the turn ratio of the primary winding 3 to the secondary winding 4 of the inverter transformer 6 to generate high-voltage waveform having a synchronized frequency and a synchronized phase from the opposite ends of the secondary winding 4 of the inverter transformer 6 of each of the inverter circuits 100, 101, 102 and 103, resulting in elimination of flicker from the electric discharge lamps 1.

Figure 2:
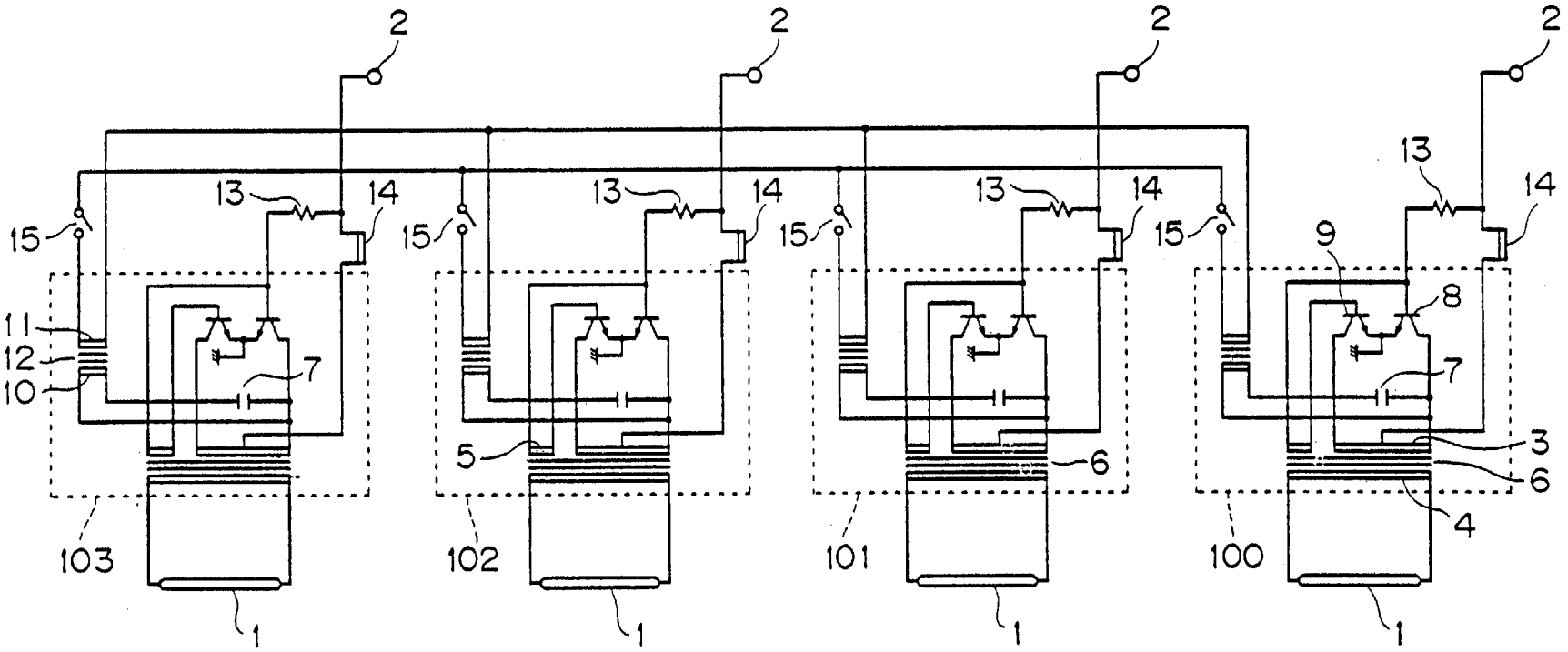
FIG. 2 is a circuit diagram showing the configuration of the second embodiment.

A description will now be given of the second embodiment of the present invention with reference to FIG. 2. In the circuit diagram of FIG. 2, one terminal of the secondary winding 11 of the synchronization transformer 12 is connected to one terminal of the secondary winding 11 of the synchronization transformer 12 of the other inverter circuit through a switch 15. Other configuration is similar to that in the embodiment shown in FIG. 1, and hence, its detailed description will be omitted. When the switch 15 is interposed on one terminal side of the secondary winding 11 in this manner, it is possible to prevent the synchronization of the oscillation frequency of a desired inverter circuit among the inverter circuits 100, 101, 102 and 103. That is, in short-circuiting the switches, high voltage waveform having a synchronized frequency and a synchronized phase is generated from the opposite ends of the secondary winding 4 of the inverter transformer 6 of each of the inverter circuits 100, 101, 102 and 103. On the other hand, in opening the switches, independent DUTY dimming and lighting-off of the electric discharge lamps 1 are enabled in the inverter circuits 100, 101, 102 and 103 respectively.

Figure 3:
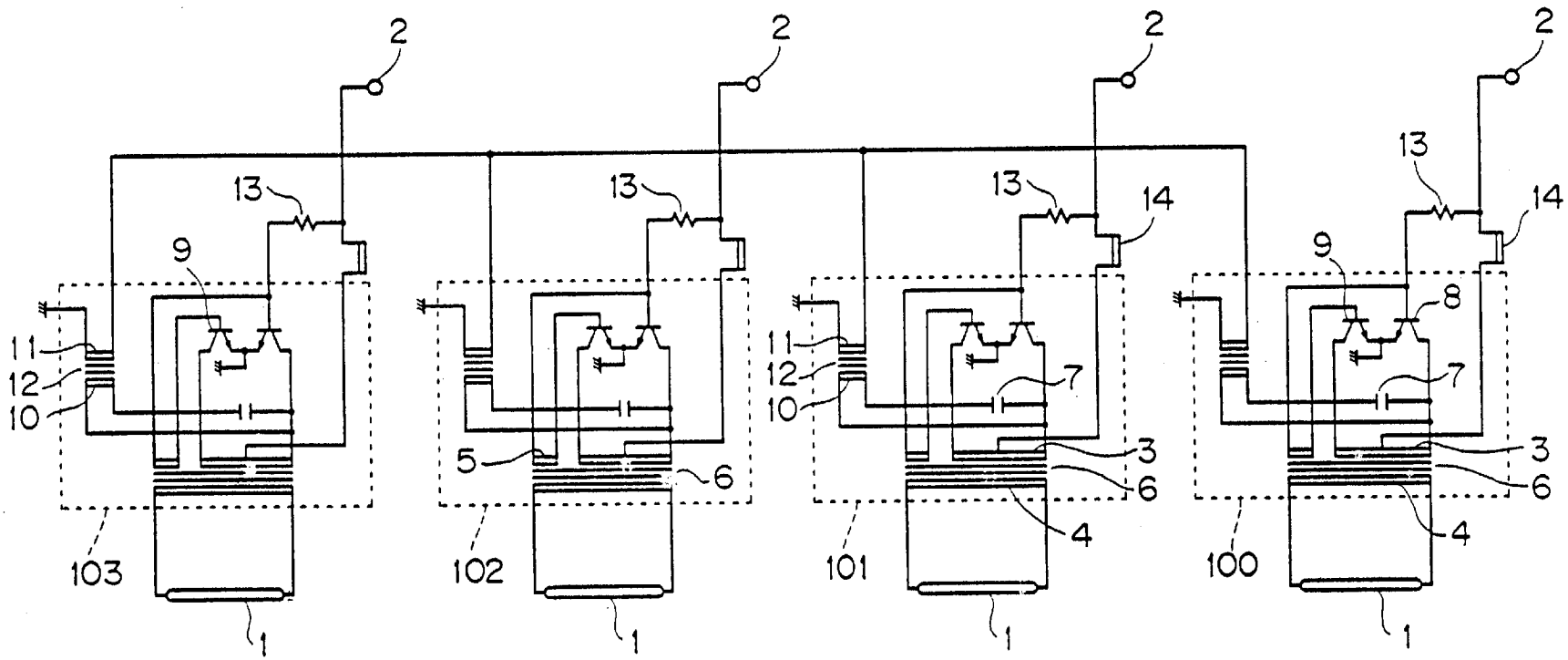
FIG. 3 is a circuit diagram showing the configuration of the third embodiment.

A description will now be given of the third embodiment of the present invention with reference to FIG. 3. In the third embodiment, one terminal of the secondary winding 11 of each synchronization transformer 12 is grounded. Other configuration is quite similar to that of the embodiment shown in FIG. 1. With the configuration of the third embodiment by grounding any terminal of the secondary winding 11 of each synchronization transformer 12 in this manner, the circuit configuration is simplified to facilitate manufacture of a substrate.

Figure 4:
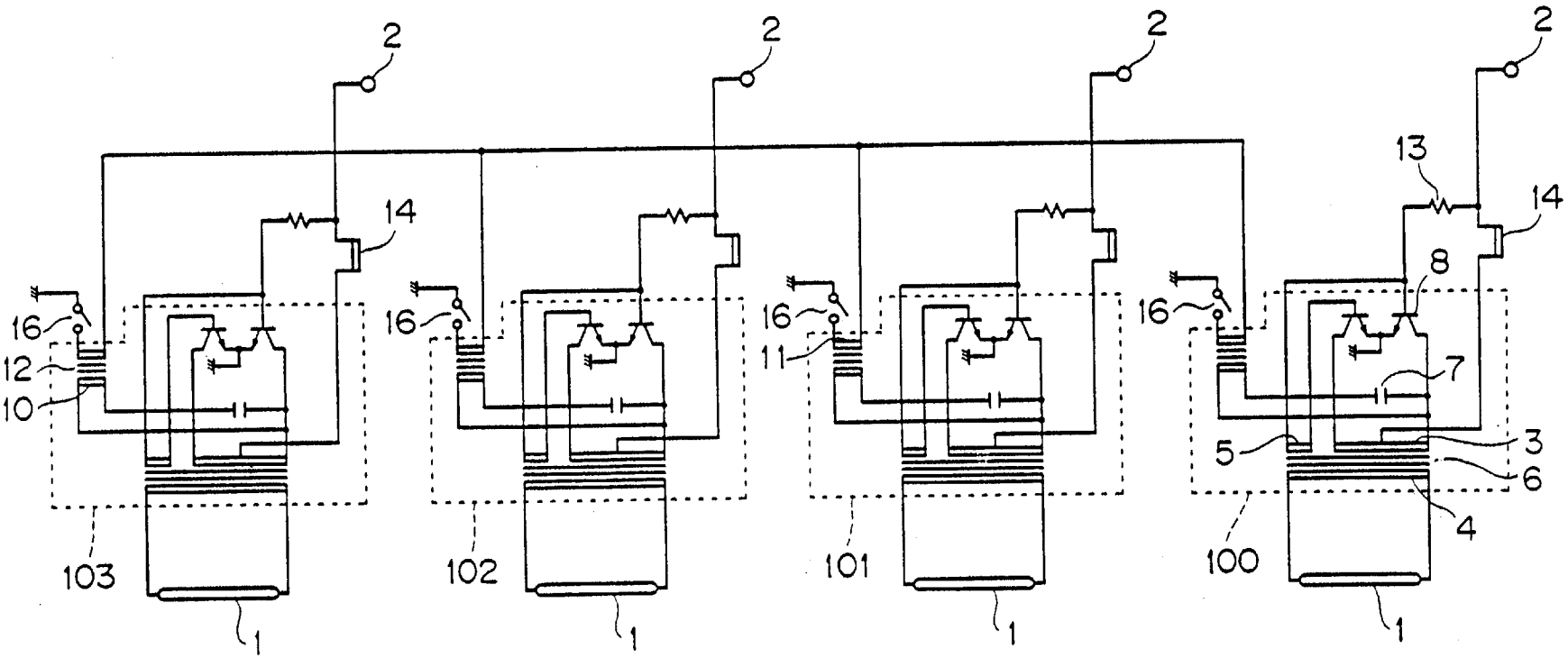
FIG. 4 is a circuit diagram showing the configuration of the fourth embodiment.

A description will now be given of the fourth embodiment of the present invention with reference to FIG. 4. In the fourth embodiment, one terminal of the secondary winding 11 of each synchronization transformer 12 is grounded through a switch 16. Other configuration is quite similar to that of the embodiment shown in FIG. 3. With the configuration of the fourth embodiment by grounding any terminal of the secondary winding 11 of each synchronization transformer 12 through the switch 16 in this manner, it is possible to make disconnection without synchronization of the resonance frequency of a desired inverter circuit among the inverter circuits 100, 101, 102 and 103. Further, independent DUTY dimming and lighting-off of the electric discharge lamps are enabled in the inverter circuits respectively.

Figure 5:
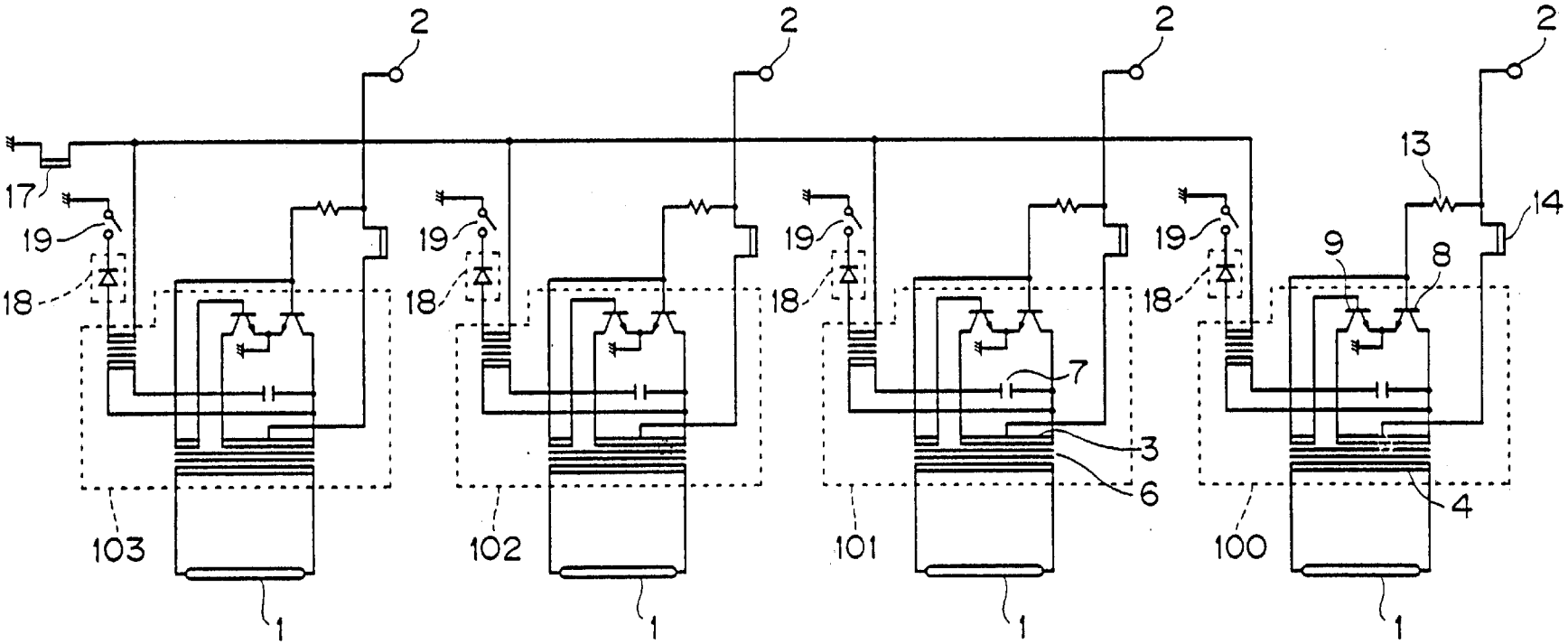
FIG. 5 is a circuit diagram showing the configuration of the fifth embodiment.

A description will now be given of the fifth embodiment of the present invention with reference to FIG. 5. In the fifth embodiment, one terminal of the secondary winding 11 of each synchronization transformer 12 is connected to a rectifying circuit 18 in series while being grounded through a switch 19. That is, one terminal of the secondary winding 11 of the synchronization transformer 12 of each of the inverter circuits 100, 101, 102 and 103 is connected to anode of a diode for configuring each rectifying circuit 18. In this case, cathode is connected to one terminal of each switch 19, and the other terminal of each switch 19 is grounded. The configuration of grounding one terminal of the secondary winding 11 of each synchronization transformer 12 through a switching element as an element permitting current to flow only in the single direction of the transistor or the like enables the operation similar to that in the fifth embodiment. Thus, the fifth embodiment of the present invention may also include the above configuration without being limited to the configuration of providing the rectifying circuit 18 and the switch 19 on one terminal side of the secondary winding 11 of each synchronization transformer 12. Further, the other terminal of the secondary winding 11 of each synchronization transformer 12 is made connection so as to be connected in parallel to each other while being grounded through an element 17 having an inductance component. The element 17 having the inductance component is required by the following reasons. That is, in the circuit diagram shown in the fifth embodiment, each rectifying circuit 18 is adapted to control the flow of current so as to permit the current to flow only in one direction. In the absence of the element 17 having the inductance component, the circuit formed by the secondary winding 11 of each synchronization transformer 12 is provided in the shape of a closed circuit permitting no loop of the current, resulting in a failure in synchronization. Connection of GND to a line permitting interconnection of the synchronization transformers 12 is required for the closed circuit to provide synchronization. Thus, the above line permitting the interconnection needs the element 17 having the inductance component so as to provide a function of GND-AC filter, before being grounded.

Figure 6:
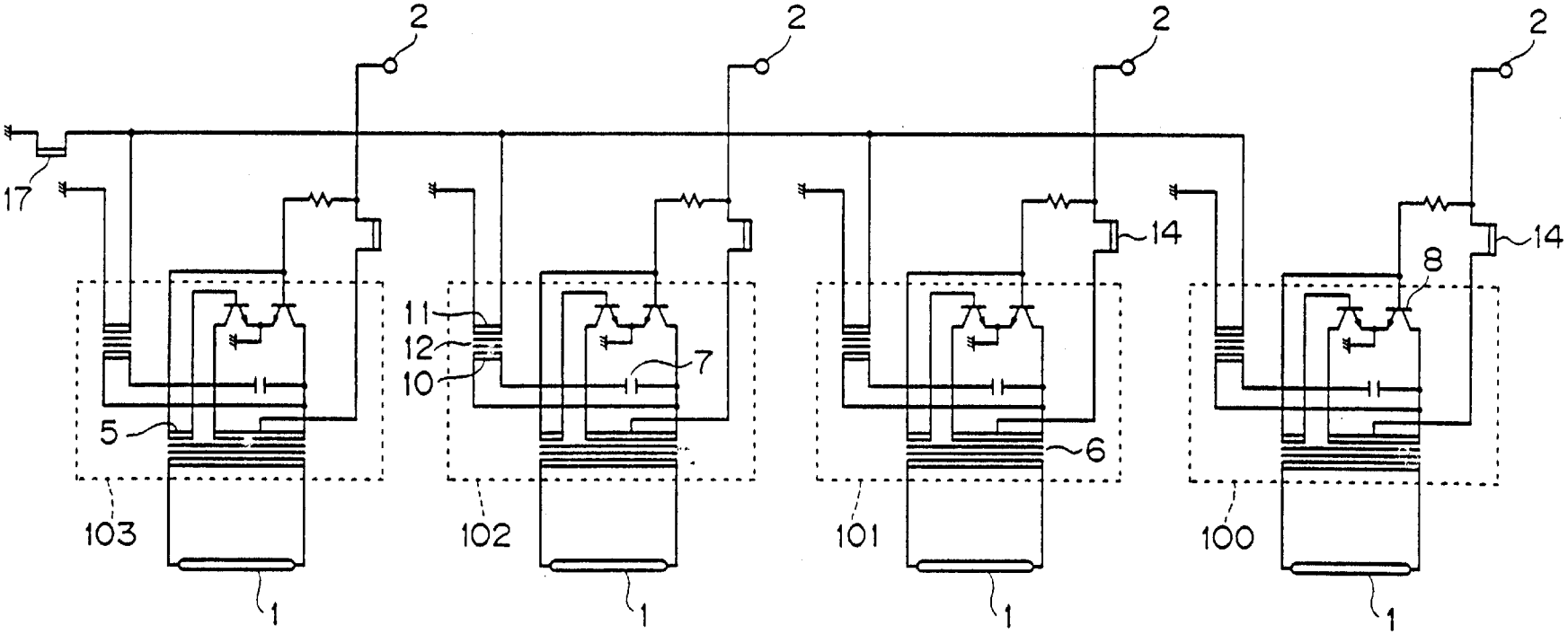
FIG. 6 is a circuit diagram showing the configuration of the sixth embodiment.
Figure 7:
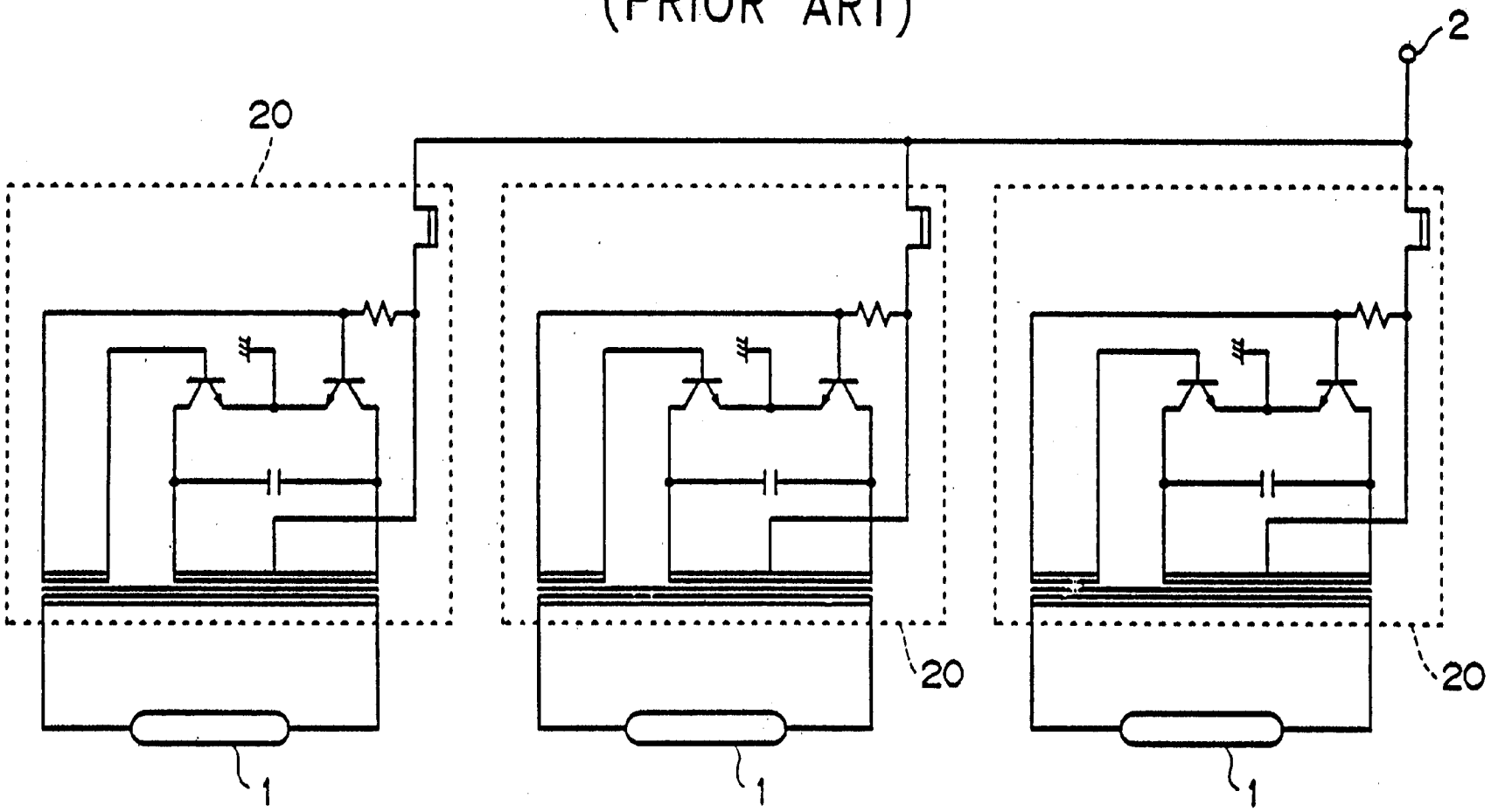
FIG. 7 (PRIOR ART)
FIG. 7 is a circuit diagram showing the prior art.

A description will now be given of the sixth embodiment of the present invention with reference to FIG. 6. In the sixth embodiment, one terminal of the secondary winding 11 of each synchronization transformer 12 is grounded, and the other terminal is made connection while being grounded through an element 17 having an inductance component. Other configuration is similar to that of the embodiment shown in FIG. 3.

As has been described, since the primary winding of each synchronization transformer is connected in parallel to each capacitor and the primary winding of each inverter transformer between the collectors of the pair of transistors for configuring the so-called resonance-type Loyer's inverter circuit, and the secondary windings of the synchronization transformers are connected together in parallel, the present invention has the effect of synchronizing the oscillation frequencies of the inverter circuits with each other, resulting in elimination of flicker from the electric discharge lamps.

Since the switch is interposed between the terminals of the secondary winding of one synchronization transformer connected in parallel to the secondary winding of the other synchronization transformer, the present invention has the effect of synchronizing the resonance frequencies of the inverter circuits with each other by short-circuiting the switch, while disconnecting a desired inverter circuit from synchronization with the other inverter circuits by opening the switches.

Further, since one terminal of the secondary winding of each synchronization transformer is grounded, the present invention has the effect of simplifying the circuit configuration to facilitate manufacture of the substrate.

Since one terminal of the secondary winding of each synchronization transformer is grounded through the switch, the present invention has the effect of simplifying the circuit configuration to facilitate manufacture of the substrate, and also disconnecting a desired inverter circuit from synchronization.

Since one terminal of the secondary winding of each synchronization transformer is grounded through the rectifying circuit and the switch, and the other terminal is made connection while being grounded through the element having the inductance component, the present invention has the effect of providing synchronization with the other inverter circuits.

What is claimed is:

1. An electric discharge lamp lighting device, comprising:

an inverter circuit using a DC power source as input and configured that a primary winding having an intermediate tap of an inverter transformer, a resonance capacitor, and a primary winding of a synchronization transformer are connected together in parallel between collectors of a pair of transistors, an electric discharge lamp is connected in parallel to a secondary winding of said inverter transformer to supply discharge power to the electric discharge lamp, the opposite terminals of a tertiary winding of said inverter transformer are connected to bases of said transistors for switching operation of said transistors by application of feedback voltage from the tertiary winding of said inverter transformer, and a secondary winding is provided for said synchronization transformer;

wherein said inverter circuit is provided every electric discharge lamp, and the secondary winding of said synchronization transformer of said inverter circuit is connected in parallel to the secondary winding of the synchronization transformer of the other inverter circuit to synchronize the oscillation frequencies of the plurality of inverter circuits with each other.

2. The electric discharge lamp lighting device according to claim 1, wherein one terminal of the secondary winding of said synchronization transformer is connected in parallel to the secondary winding of the synchronization transformer of the other inverter circuit through a switch.

3. The electric discharge lamp lighting device according to claim 1, wherein one terminal of the secondary winding of said synchronization transformer is grounded.

4. The electric discharge lamp lighting device according to claim 1, wherein one terminal of the secondary winding of said synchronization transformer is grounded through a switch.

5. The electric discharge lamp lighting device according to claim 1, wherein one terminal of the secondary winding of said synchronization transformer is grounded through a rectifying circuit and a switch, and the other terminal of the secondary winding of said synchronization transformer is made connection while being grounded through an element having an inductance component.

6. The electric discharge lamp lighting device according to claim 1, wherein one terminal of the secondary winding of said synchronization transformer is grounded, and the other terminal of the secondary winding of said synchronization transformer is made connection while being grounded through an element having an inductance component.

* * * * *